US007669282B2

(12) United States Patent
Jung et al.

(10) Patent No.: US 7,669,282 B2
(45) Date of Patent: *Mar. 2, 2010

(54) VACUUM CLEANER

(75) Inventors: Jae Duck Jung, Changwon-si (KR); Ha Jong Sung, Changwon-si (KR)

(73) Assignee: LG Electronics Inc., Seoul (KR)

( * ) Notice: Subject to any disclaimer, the term of this patent is extended or adjusted under 35 U.S.C. 154(b) by 1089 days.

This patent is subject to a terminal disclaimer.

(21) Appl. No.: 11/006,776

(22) Filed: Dec. 8, 2004

(65) Prior Publication Data

US 2005/0198770 A1 Sep. 15, 2005

(30) Foreign Application Priority Data

Mar. 11, 2004 (KR) ..... 10-2004-0016491
Mar. 11, 2004 (KR) ..... 10-2004-0016492
Mar. 11, 2004 (KR) ..... 10-2004-0016494

(51) Int. Cl.
*A47L 9/10* (2006.01)

(52) U.S. Cl. ..... 15/353; 15/348; 15/352

(58) Field of Classification Search ..... 15/348, 15/352, 353

See application file for complete search history.

(56) References Cited

U.S. PATENT DOCUMENTS 3,815,335 A 6/1974 Barnebey
6,003,196 A 12/1999 Wright et al.
6,171,356 B1 1/2001 Twerdun
6,192,550 B1 * 2/2001 Hamada et al. ..... 15/352
6,406,505 B1 6/2002 Oh et al.
6,434,785 B1 8/2002 Vandenbelt et al.
6,436,160 B1 * 8/2002 Stephens et al. ..... 55/337
6,579,334 B2 6/2003 Oh et al.
6,810,557 B2 * 11/2004 Hansen et al. ..... 15/353
6,818,032 B2 * 11/2004 Bilek et al. ..... 55/337

(Continued)

FOREIGN PATENT DOCUMENTS

JP 2003-339596 A 12/2003

(Continued)

OTHER PUBLICATIONS

Korean Office Action dated May 27, 2009 for Application No. 10-2004-0024413.

(Continued)

*Primary Examiner*—Joseph J Hail, III
*Assistant Examiner*—Shantese McDonald
(74) *Attorney, Agent, or Firm*—Ked & Associates LLP

(57) ABSTRACT

Disclosed is a vacuum cleaner including a suction nozzle; a dust collecting assembly which includes a dust collecting container having a dust collecting space and an opened bottom, an inlet, a filtering device provided in the dust collecting container, and an outlet; and a cleaner body which includes a dust collecting assembly receiving recess for detachably receiving the dust collecting assembly, a polluted air outlet provided at the dust collecting assembly receiving recess and communicating with the inlet of the dust collecting assembly, a clean air inlet provided on an inner wall of the dust collecting assembly receiving recess to face the dust collecting assembly and communicating with the outlet of the dust collecting assembly, and a clean air conduit having a fan provided therein, for exhausting the clean air to the outside of the vacuum cleaner.

24 Claims, 12 Drawing Sheets

U.S. PATENT DOCUMENTS

| | | | | |
|---|---|---|---|---|
| 6,994,739 | B2 | 2/2006 | Park | |
| 7,052,523 | B2 | 5/2006 | Murphy | |
| 7,086,119 | B2 | 8/2006 | Go et al. | |
| 7,134,165 | B2 | 11/2006 | Pullins | |
| 7,175,682 | B2 | 2/2007 | Nakai et al. | |
| 7,207,083 | B2 | 4/2007 | Hayashi | |
| 7,360,275 | B2 | 4/2008 | Allgeier et al. | |
| 2003/0066156 | A1* | 4/2003 | Yang | 15/327.2 |
| 2003/0131441 | A1 | 7/2003 | Murphy et al. | |
| 2005/0198767 | A1 | 9/2005 | Kang et al. | |
| 2005/0198768 | A1 | 9/2005 | Jung et al. | |
| 2005/0198769 | A1 | 9/2005 | Lee et al. | |
| 2005/0198770 | A1 | 9/2005 | Jung et al. | |
| 2005/0198771 | A1 | 9/2005 | Min et al. | |

FOREIGN PATENT DOCUMENTS

| | | | |
|---|---|---|---|
| KR | 10-2000-0039238 | A | 7/2000 |
| KR | 10-0445470 | B | 8/2004 |
| KR | 10-0487938 | B | 4/2005 |
| KR | 10-0540439 | B | 12/2005 |

OTHER PUBLICATIONS

Korean Office Action dated May 27, 2009 for Application No. 10-2004-0016480.

Korean Office Action dated May 29, 2009 for Application No. 10-2004-0016482.

Korean Office Action dated May 29, 2009 for Application No. 10-2004-0016489.

Korean Office Action dated May 29, 2009 for Application No. 10-2004-0016490.

Korean Office Action dated May 29, 2009 for Application No. 10-2004-0016492.

* cited by examiner

VACUUM CLEANER

CROSS-REFERENCE TO RELATED APPLICATIONS

This application claims the benefit of Korean Application No. P2004-16492, P2004-16494, and P2004-16491, three of which were filed on Mar. 11, 2004, and are hereby incorporated by reference as if fully set forth herein.

BACKGROUND OF THE INVENTION

1. Field of the Invention

The present invention relates to a vacuum cleaner, and more particularly, to a vacuum cleaner with a dust collecting assembly detachably provided.

2. Discussion of the Related Art

In general, as an apparatus for cleaning a floor or a carpet in a room, a vacuum cleaner sucks polluted outside air containing impurities through operation of an air sucking device such as a motor provided in a cleaner body, and collects impurities separated from polluted air, and discharges cleaned air to an outside thereof.

Hereinafter, a related art vacuum cleaner will be described referring to FIG. 1. Referring to FIG. 1, the related art vacuum cleaner includes a cleaner body 1 and a suction nozzle 2. An air sucking device (not shown) such as a motor and a fan sucking interior air is provided in the cleaner body 1, and polluted outside air is sucked through the suction nozzle 2 by air suction force generated by the air sucking device.

In this case, the cleaner body 1 includes a main controller for controlling the abovementioned air sucking device and the cleaner, and a dust collector receiving groove for receiving a dust collector 5 separating impurities from the polluted air sucked through the suction nozzle 2, and collecting the impurities.

A wheel 8 is provided on both sides at a lower part of the cleaner body 1, and an outlet 8*a* is provided at the wheel 8 for discharging clean air separated from the impurities in the dust collector.

Between the cleaner body 1 and the suction nozzle 2, a coupling pipe 3 is provided, the coupling pipe 3 including a sucking hose 3*a* made of a flexible material, a handle 3*b*, and an extended pipe 3*c*, for communicating the cleaner body 1 with the suction nozzle 2.

When power is applied the vacuum cleaner structured as aforementioned, and an operation of the vacuum cleaner is started, by the air suction force generated from the air sucking device in the cleaner body 1, the polluted outside air is passed through the suction nozzle 2 and the coupling pipe 3, and flowed into the dust collector disposed in the cleaner body.

The impurities such as dust contained in the polluted air are separated from the dust collector 5, and only cleaned air is discharged to the outside through the outlet 8*a*, such that the interior cleaning is performed.

In the vacuum cleaner configured and operated as abovementioned, when a predetermined time is passed, and the dust collector is filled with impurities, a user needs to separate the dust collector from the cleaner body 1 to empty, and mount the dust collector back into the dust collector receiving groove of the cleaner body.

However, the vacuum cleaner with the dust collecting assembly 5 detachably provided as abovementioned needs to have airtightness between the dust collecting assembly and the cleaner body, such that air is not lost during an operation of the vacuum cleaner, and the air sucking device is prevented from being overloaded.

Therefore, development of a vacuum cleaner is requested, the vacuum cleaner having a structure wherein airtightness between the dust collector and the cleaner body is maintained, the dust collector is easily mounted, and discharging collected impurities and cleaning the inside of the dust collector are both easy.

SUMMARY OF THE INVENTION

Accordingly, the present invention is directed to a vacuum cleaner that substantially obviates one or more problems due to limitations and disadvantages of the related art.

An object of the present invention is to provide a vacuum cleaner for securing airtightness between a dust collecting assembly and a cleaner body, and enabling to attach and detach the dust collecting assembly.

Another object of the present invention is to provide a vacuum cleaner having a filtering device of which cleaning and exchanging are easy.

Another object of the present invention is to provide a vacuum cleaner having a structure that impurities collected in the dust collecting assembly are easily discharged, and cleaning the inside thereof is easy.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a vacuum cleaner includes a suction nozzle for sucking polluted air containing impurities by operation of a motor; a dust collecting assembly which includes a dust collecting container having a dust collecting space and an openable and closable bottom, the dust collecting space formed in a cylindrical form, an inlet through which the polluted air is drawn to the inside of the dust collecting container, a filtering device detachably provided in the dust collecting container for filtering impurities such as dust, and an outlet through which clean air is exhausted; and a cleaner body which includes a dust collecting assembly receiving recess for detachably receiving the dust collecting assembly, a polluted air outlet provided at the dust collecting assembly receiving recess, communicating with the inlet of the dust collecting assembly, and discharging the polluted air sucked through the suction nozzle to the dust collecting assembly, a clean air inlet provided on an inner wall of the dust collecting assembly receiving recess so as to face the direction of mounting the dust collecting assembly and communicating with the outlet of the dust collecting assembly, and a clean air conduit having a fan provided therein and rotated by a motor, wherein a first end of the clean air conduit communicating with the clean air inlet and a second end of the clean air conduit has a clean air outlet for exhausting the clean air to the outside of the vacuum cleaner.

The dust colleting container includes a top container formed in a cylindrical form; a bottom lid having a first end rotatably connected to a first side of a lower end of the top container; and a lid fixing device for selectively fixing the bottom lid such that the bottom lid opens or closes a bottom of the top container.

The lid fixing device includes a hook member having a hook caught by a second end of the bottom lid at a first end thereof; and a hook supporter provided at a side of the top container for supporting the hook member.

The hook member is rotatably coupled to the hook supporter and has a second end coupled to an elastic member providing a restoring force.

The bottom lid includes a projection provided at a second end of the bottom lid and being caught by the hook of the hook member.

The dust collecting container further includes a top plate having a pass through hole which is perpendicularly bored so as to insert or withdraw the filtering device from an upper side of the dust collecting assembly, wherein the filtering device is coupled to the top plate.

The filtering device is coupled to the top plate by means of a projection formed at an upper end of the filtering device and a coupling lever provided on an upper surface of the top plate for fixing the projection.

The top plate is openably and closably provided at an upper part of the dust collecting container.

The filtering device includes a filter formed in a cylindrical form for filtering impurities; and a filter supporter having an upper end coupled to the top plate for supporting the filter.

The outlet of The dust collecting assembly is attached or detached from a front of the cleaner body, and the outlet of the dust collecting assembly discharges the clean air to a rear side of the dust collecting container, and the clean air inlet is provided on a rear inner wall of the dust collecting assembly receiving recess.

The dust collecting assembly further includes an inner flow tube having a first end communicating with the outlet of the dust collecting assembly and a second end communicating with the filtering device, and guiding the clean air from the filtering device to the outside of the dust collecting container.

The inner flow tube of the dust collecting assembly includes a first flow tube having a fist end communicating with the outlet of the dust collecting assembly and a second end extended to a center of the dust collecting container; and a second flow tube having a first end connected to a second end of the first flow tube, and a second end extended upward to a lower end of the filtering device.

A connecting part of the first flow tube and the second flow tube is curved or inclined so as to minimize flow resistance of the clean air discharged from the dust collecting space.

The inner flow tube is incorporated integrally into the bottom lid and passes through a rim of the bottom lid.

The inner flow tube includes a flow tube cover provided at a second end thereof so as to prevent the impurities from being flowed into the inside thereof.

The dust collecting assembly further includes a separation plate for dividing an inner space of the dust collecting container into an upper space and a lower space.

The separation plate is rotatably provided in the dust collecting container. In this case, the separation plate includes two semicircular plates provided in the dust collecting container so that the semicircular plates rotate in an upper direction of the dust collecting container.

The inlet of the dust collecting assembly is provided in a tangential direction at a predetermined location on a side of the dust collecting container such that the polluted air drawn into the inner space of the dust collecting container spirally flows.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
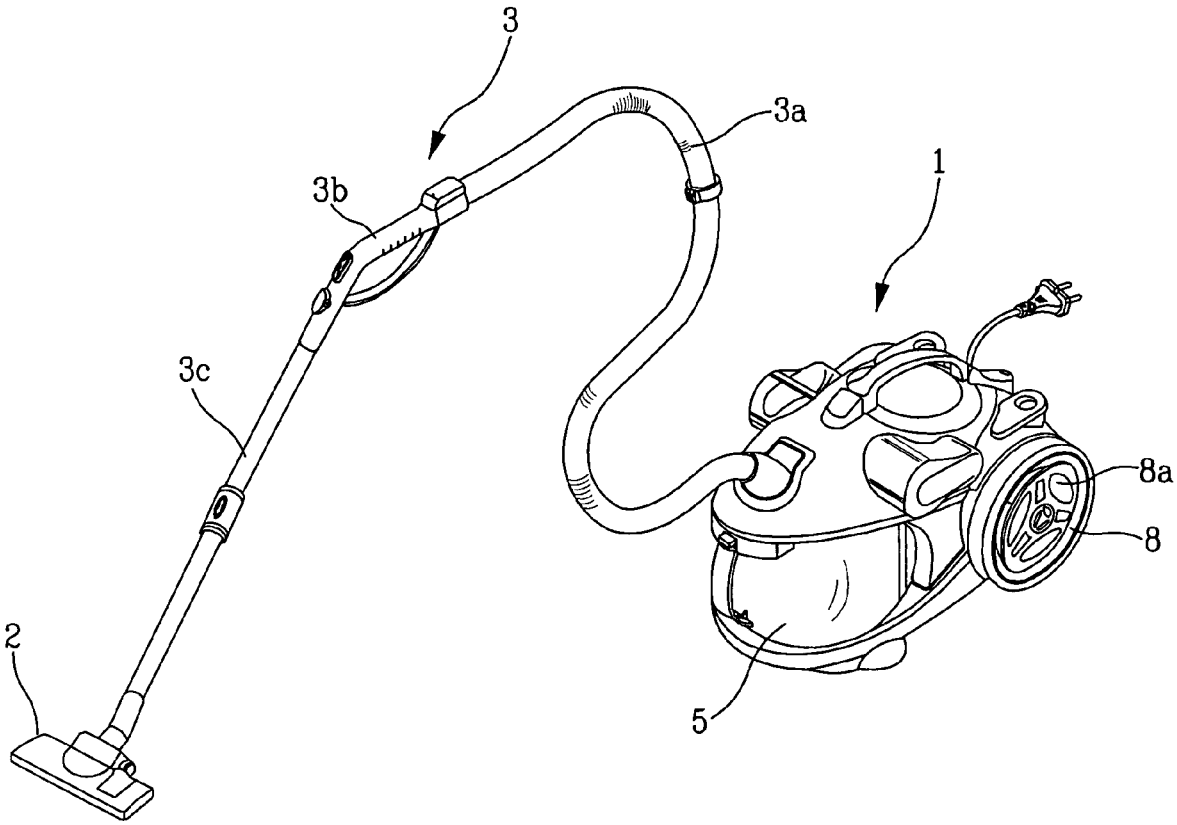
FIG. 1 illustrates a perspective view showing a related art vacuum cleaner.
Figure 2:
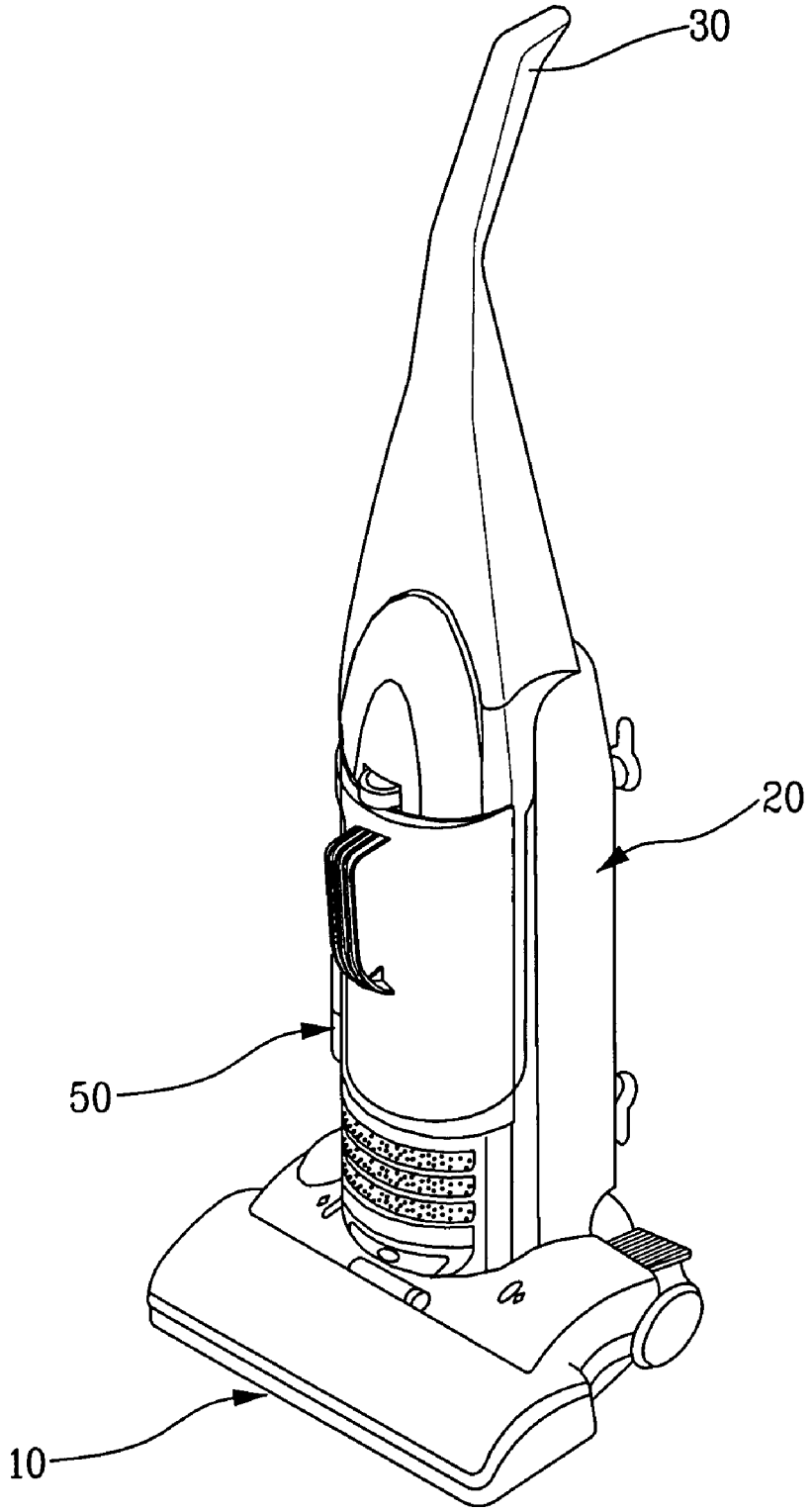
FIG. 2 illustrates a perspective view showing a vacuum cleaner in accordance with a preferred embodiment of the present invention.
Figure 3:
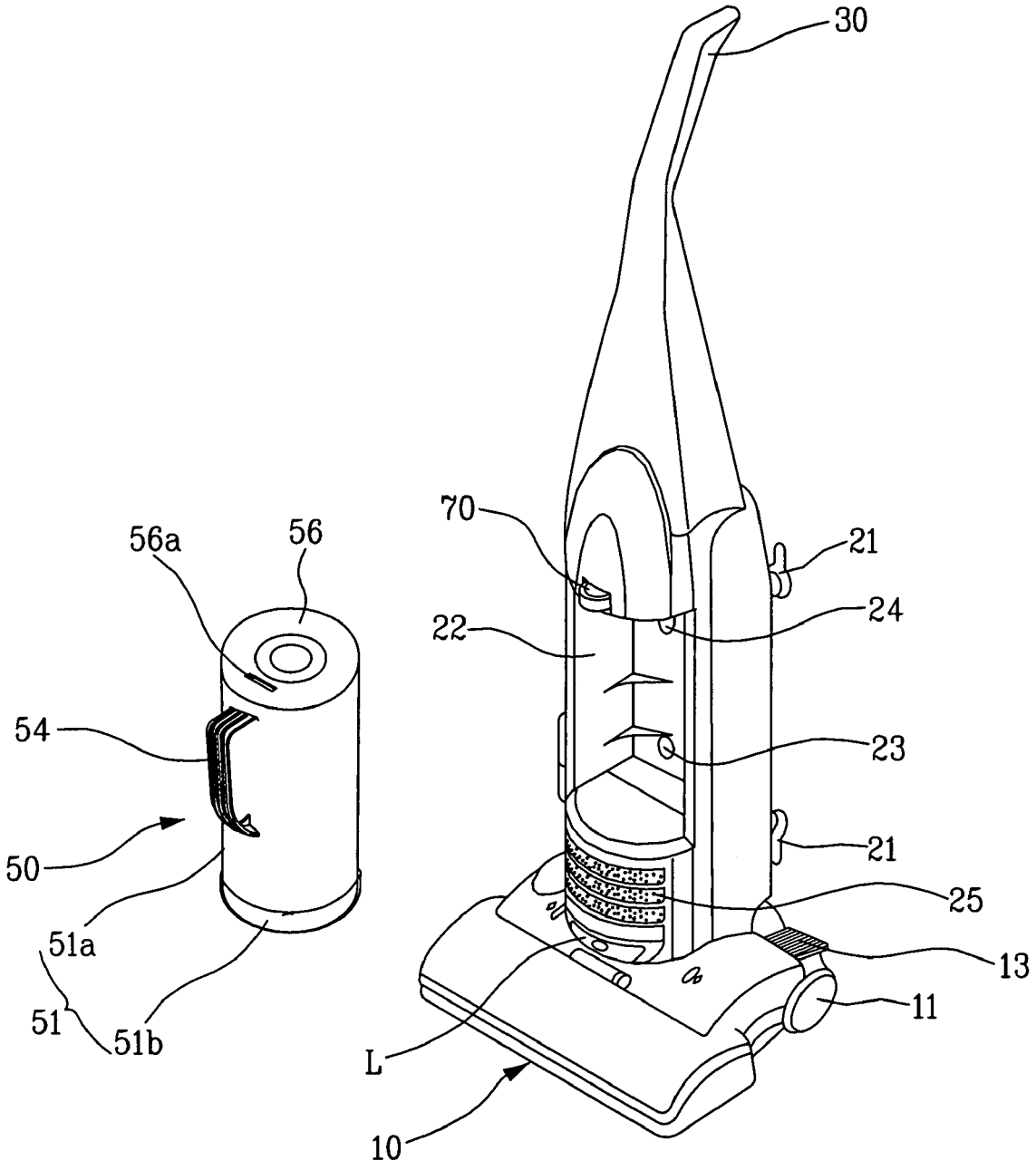
FIG. 3 illustrates a perspective view showing a dust collecting assembly being separated from a cleaner body, the dust collecting assembly provided in a vacuum cleaner in accordance with the present invention.
Figure 4:
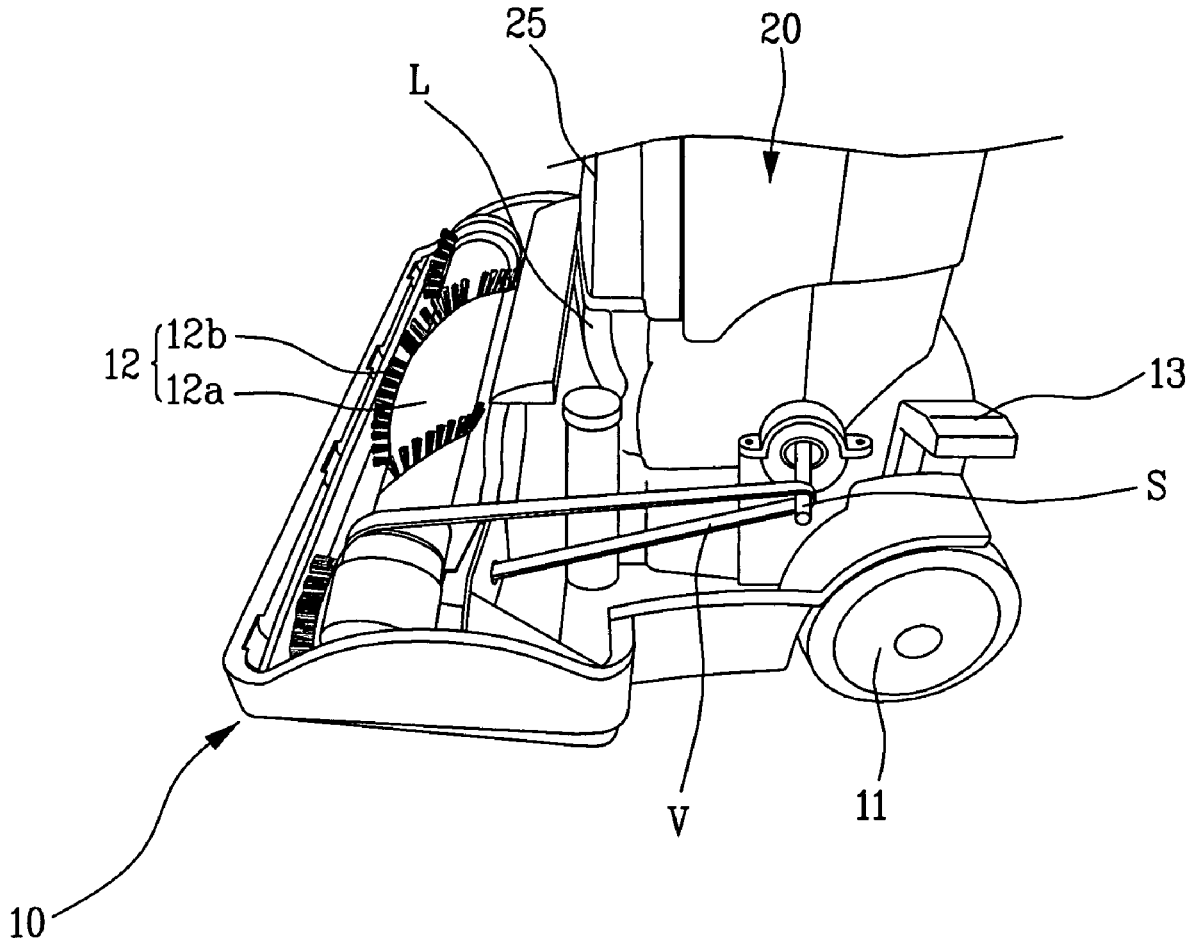
FIG. 4 illustrates a perspective view showing an inside structure of a suction nozzle provided in a vacuum cleaner in accordance with the present invention.
Figure 5:
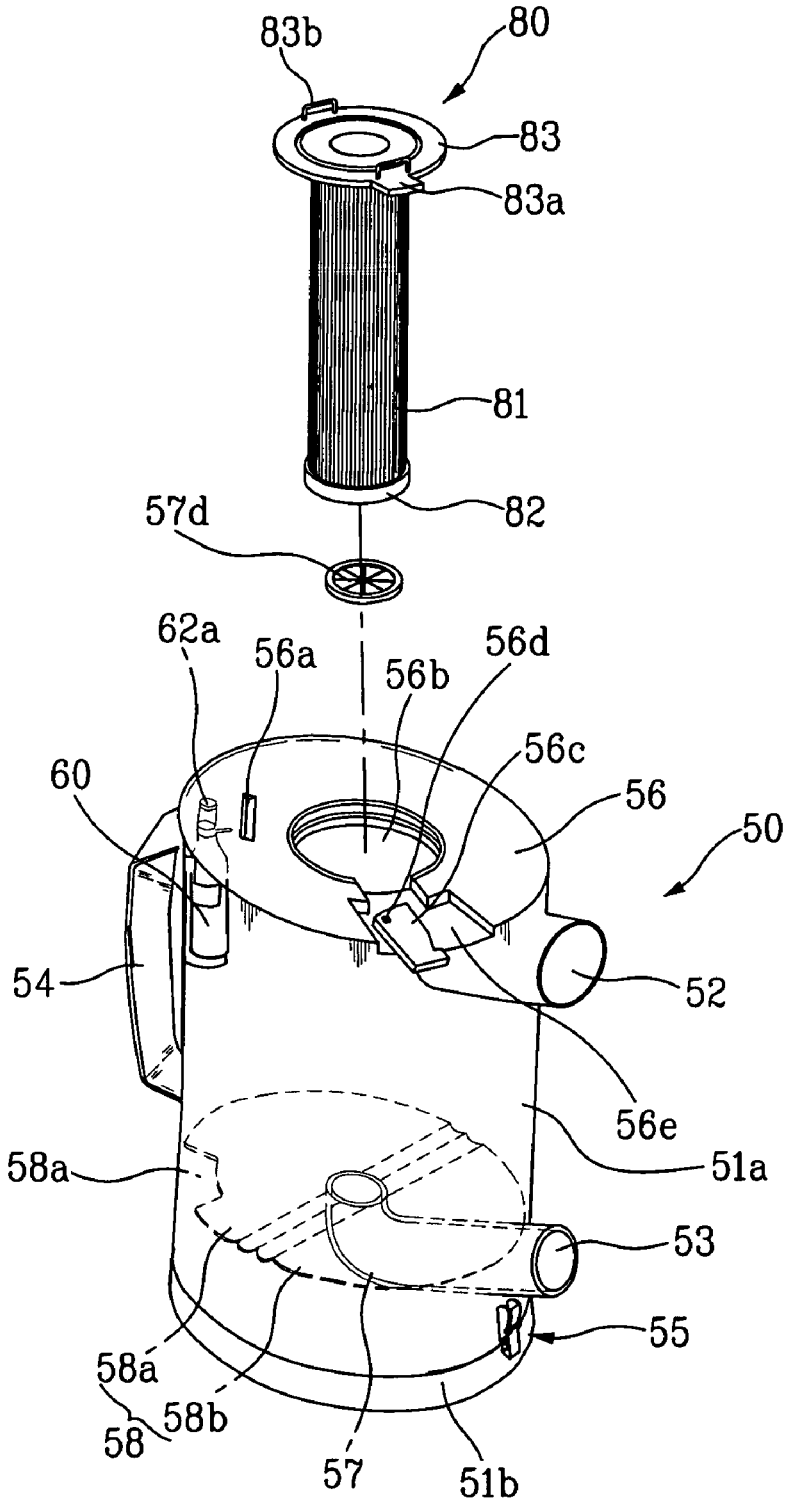
FIG. 5 illustrates a perspective view showing a first embodiment of a dust collecting assembly provided in a vacuum cleaner in accordance with the present invention.

Referring to FIGS. 2 to 4, a vacuum cleaner in accordance with the present invention includes a suction nozzle 10 moving along a floor and sucking air containing impurities, a cleaner body 20 coupled with the head, and a handle 30 coupled with the cleaner body.

The suction nozzle 10 includes wheels 11 at a lower part thereof, moves along the floor, and sucks polluted air containing impurities from outside through a main inlet (not shown) provided at a lower part thereof.

In this case, it is desirable that a width of the suction nozzle 10 is 12 to 16 inches, and an agitator is provided on an inside of the main inlet of the suction nozzle. The agitator (12) is for separating the impurities such as dust stuck on the floor and sucking the impurities along with outside air. The agitator 12 includes a rotation axis 12*a* formed in a cylindrical form and having both ends supported by both sides of the main inlet, and a rotation brush 12*b* provided on an outer circumferential surface of the rotation axis. In this case, it is desirable that the rotation brush 12*b* is provided in a spiral direction on the outer circumferential surface of the rotation axis 12*a*.

The cleaner body 20 is rotatably provided at an upper part of the suction nozzle 10 to be rotatable in a predetermined range in a back and forth direction, and a rotation adjusting lever 13 is provided at an upper rear surface of the suction nozzle 10 for adjusting rotation of the cleaner body 20.

Owing to the structure abovementioned, a user can adjust the cleaner body 20 to a desired angle by pushing or pulling the handle 30 while stepping on the rotation adjusting lever 13 according to the height of the user or a location to be cleaned.

An electric wire fixing member 21, on which an electric wire is wound, is provided on a rear surface of the cleaner body 20. In more detail, the electric wire fixing member 21 is formed in a ring form to be symmetrical to each other in up and down direction or on right and left direction on a rear surface of the cleaner body.

In the cleaner body 20, an air sucking device (not shown) having a motor is provided for generating air suction force, and the polluted outside air is sucked through the main inlet of the suction nozzle 10 by an operation of the air sucking device.

In this case, it is desirable that the rotating axis (S) of the motor is connected to the rotating axis 12*a* of the agitator of the suction nozzle by means of a belt, such that the motor generates the air suction force for sucking the polluted air and makes the rotation brush 12*b* of the agitator and the rotating axis to rotate. It is also desirable that a sensor, particularly a temperature sensor (not shown) is provided at the cleaner body 20 for sensing overload of the air sucking device so as to automatically cut off power when the air sucking device is overheated more than a predetermined temperature. The air sucking device may be provided in the suction nozzle 10. On a lower front surface of the man body 20, a lamp (L) is provided for lightening a front of the cleaner.

On the front portion of the man body 20, a dust collecting assembly receiving recess 22 which receives the dust collecting assembly 50 is formed, the dust collecting assembly 50 separating impurities contained in the polluted air from the polluted air, and collecting.

The dust collecting assembly receiving recess 22 includes a receiving space hollowed rearward so as to have a space for receiving the dust collecting assembly 50 on a front surface of the cleaner body 20. In other words, the dust collecting assembly receiving recess 22 is sunken on the front surface of the cleaner body to be correspondent to an exterior of the dust collecting assembly 50 for receiving the dust collecting assembly 50.

The dust collecting assembly 50 collects the impurities separated from the polluted air sucked through the main inlet of the suction nozzle 10, and exhausts cleaned air.

For attaching and detaching the dust collecting assembly 50, a detaching device 70 is provided at an upper part of the dust collecting assembly receiving recess 22, the detaching device 70 having restoring force by an elastic member, and a groove 56*a* is provided on a upper surface of the dust collecting assembly 50, for engaging with the detaching device 70.

The detaching device 70 and the groove 56*a* structured as abovementioned fix the dust collecting assembly 50 on the cleaner body 20 for installation of the dust collecting assembly 50, and release the dust collecting assembly 50 for separation of the dust collecting assembly 50.

In other words, for separation of the dust collecting assembly 50, a user separates the dust collecting assembly 50 from the cleaner body 20 by pressing the detaching device 70 and releasing the detaching device from the groove 56*a*, and for installation of the dust collecting assembly, the user fixes the dust collecting assembly 50 on the cleaner body 20 by pushing the dust collecting assembly 50 from the front of the cleaner body into the dust collecting assembly receiving recess 22 and making the detaching device 70 to engage with the groove 56*a* by means of the restoring force.

The dust collecting assembly 50 structured as abovementioned collects the impurities by a cyclone principle, or by using a filtering device. As a method for separating the impurities in the dust collecting assembly 50, both the cyclone principle and the filtering device can be adopted at the same time.

The dust collecting assembly configured to collect the impurities by using the cyclone principle makes the air flow in a cyclonic movement, the air drawn into the dust collecting assembly, and the dust collecting assembly configured to separate the impurities by the method for separating impurities by using a filtering device has the filtering device in the dust collecting assembly so as to remove the impurities from the polluted air and exhaust clean air to the outside thereof. At the dust collecting assembly configured to adopt both of the cyclone principle and the filtering device includes both structures abovementioned.

Hereinafter, referring to FIG. 3 to 8, a first embodiment of the dust collecting assembly structured to separate the impurities such as dust by using the cyclone principle firstly, and then separate fine dust by using the filtering device secondly, and the vacuum cleaner with the dust collecting assembly will be described.

Referring to FIG. 3 to 8, the dust collecting assembly 50 includes a dust collecting container 51 formed in a perpendicular form, having a center axis perpendicularly provided at the dust collecting assembly receiving recess 22, and having a dust collecting space formed in cylindrical form for separating and collecting impurities such as dust by using the cyclone principle therein, an inlet 52 and an outlet 53 provided at a predetermined location on a side of the dust collecting container, a filtering device 80 provided in the dust collecting container for filtering impurities such as dust, and a dust collecting container handle 54 provided on a front outer wall of the dust collecting container 54.

In the present invention, the outlet 53 of the dust collecting assembly exhausts clean air to a rear side thereof, and corresponding to the outlet of the dust collecting assembly, a clean air inlet 23 is provided on a rear inner wall of the dust collecting assembly receiving recess 22 for communicating with the outlet 53 of the dust collecting assembly. In other words, the clean air inlet 23 is provided on the rear inner wall of the dust collecting assembly receiving recess 22 to face the front thereof.

The cleaner body 20 includes a polluted air conduit (not shown) guiding the polluted air sucked through the main inlet of the suction nozzle 10 to the inlet 52 of the dust collecting assembly and having a polluted air outlet coupled at an end thereof to the inlet 52 of the dust collecting assembly, and a clean air conduit (not shown) including the clean air inlet 23 provided at a first end thereof and a clean air exhausting port 25 provided at a second end thereof for exhausting the clean air to the outside of the vacuum cleaner. Therefore, the polluted air conduit communicates with the inlet 52 of the dust collecting assembly and the clean air conduit communicates with the outlet 53 of the dust collecting assembly The polluted air conduit is provided to pass through the inside of the cleaner body 20, or to be exposed outside of the cleaner body 20. In this case, when the polluted air conduit is provided to be exposed outside of the cleaner body 20, the polluted air conduit is made of an elastic material and a predetermined portion of the conduit is detachably coupled to the cleaner body 20 such that the user can clean a corner by using the polluted air conduit. When the corner is cleaned as abovementioned, it is desirable that an accessory coupled to the polluted air conduit is provided on a rear surface or on a side of the cleaner body.

Meanwhile, a fan (not shown) is provided at the air sucking device such as the motor. In the present invention, it is desirable that the fan is provided at the clean air conduit for forcing air flow in the vacuum cleaner.

Owing to the dust collecting assembly 50 and the cleaner body 20 structured as abovementioned, when the dust collecting assembly 50 is fit in the dust collecting assembly receiving recess 22 of the cleaner body, the clean air inlet 23 and the outlet of the dust collecting assembly 53 are more tightly coupled by pushing force of the user. Furthermore, when carelessness or an inexperienced manipulation of the user caused a gap between the clean air inlet 23 and the outlet of the dust collecting assembly 53, and airtightness is not maintained there, because the air is sucked from the clean air inlet 23 by the operation of the air sucking device, the dust collecting assembly 50 is tightly adhered to the rear side of the dust collecting assembly receiving recess 22 by air suction force, thereby coupling the clean air inlet 23 with the outlet of the dust collecting assembly 53 without any gap therebetween. Therefore, the airtighteness between the dust collecting assembly 50 and the cleaner body 20 is maintained.

Owing to the abovementioned principle, maintaining airtightness between the dust collecting assembly and the cleaner body is enabled by providing the clean air inlet 23 of the cleaner body on the inner wall of the dust collecting assembly receiving recess 22 such that the clean air inlet 23 of the cleaner body opposes to a direction of mounting the dust collecting assembly 50.

It is desirable that a packing member (not shown) is provided between the clean air inlet 22 and the outlet 53 of the dust collecting assembly for maintaining airtightness therebetween, so as to secure the airtightness between the dust collecting assembly 50 and the cleaner body 20.

In this case, it is desirable that the packing member is made of an elastic material such as rubber or silicon.

The inlet 52 of the dust collecting assembly is provided at a predetermined location of the upper part of the dust collecting container in a tangential direction such that the polluted air drawn into the dust collecting space flows spirally in the dust collecting container 51

In more detail, the inlet 52 of the dust collecting assembly is provided in the tangential direction on the upper side of the dust collecting container 51, and the polluted air guided by the polluted air conduit is drawn into in the dust collecting container 51 and is separated into the impurities and clean air, by the difference of centrifugal fore between impurities and clean air.

In this case, the inlet 52 of the dust collecting assembly is projected to the outside so as to be inserted into and coupled to the polluted air outlet, and the dust collecting assembly 52 is inclined to a predetermined degree such that the air flows from the upper part to the lower part thereof.

In the present invention, the dust collecting container 51 includes a bottom openably and closably provided. For this, the dust collecting container 51 includes a top container 51*a* formed in a cylindrical form, having an opened bottom, a bottom lid 51*b* having an end provided at a lower end of the top container, a lid fixing device 55 for selectively fixing the bottom lid 51*b*, and a top plate 56 forming an upper surface of the top container.

The top plate 56 is incorporated integrally into or detachably connected to the top container 51*a*, and the filtering device 80 is detachably provided on the top plate 56.

In more detail, the filtering device 80 includes a filter 81 formed in a cylindrical form and filtering the impurities, and filter supporters 82 and 83 for supporting the filter 81.

The filter supporter 82, 83 includes a bottom end supporter 82 supporting a lower end of the filter 81 so as to maintain a circular form thereof, and a top end supporter 83 supporting a top end of the filter. The filter supporter, of course, may be formed in a cylindrical form (not shown) with a plurality of pass through holes supporting an inner surface of the filter 81. The filtering device 80 further includes a supplementary filter (not shown) provided on an inner surface of the filter 81 for filtering minute dust.

In this case, it is desirable that the filter 81 has a plurality of blocks perpendicularly provided on an outer circumferential surface at predetermined intervals along a circumferential direction, and formed in a pleated form, such that an area being in contact with flowing air is maximized. The filter 81 includes more than a predetermined strength with regard to a strong flow of air, and made of a material that maintains the form during washing. It is also desirable that the filter supporter is made of synthetic resins, which is washable.

A clean air guiding passage 84 is formed in the filtering device 80 through which the air passed through the filters to be cleaned flows.

Meanwhile, the top end supporter 83 of the filtering device is formed to be larger than the bottom end supporter 82 and is detachably coupled to the top plate 56. In the present invention, the filtering device 80 is configured to be inserted or withdrawn at an upper side of the top plate 56, that is, at the dust collecting container 51 so as to make it easier to exchange or clean.

Therefore, in the middle of the top plate 56, a pass through hole 56*b* which is perpendicularly bored is provided so as to allow the filtering device pass therethrough.

The pass through hole 56*b* is formed in a circular form, corresponding to the top end of the filtering device 80, more particularly the top end supporter 83, and the top surface of the edge of the pass through hole 56*b* has a step such that the bottom surface of the edge of the top end supporter 83 is stably mounted.

For fixing the filtering device 80, on the circumferential surface of the top end supporter 83, a projection 83*a* is radially projected, and on the top surface of the top plate 56, a coupling lever 56*c* is rotatably connected by a rotation axis 56*d* or a hinge for selectively fixing the projection 83*a*. And, a lever mounting groove 56*e* is formed on the upper surface of the top plate 56, wherein the projection 83*a* is stably provided on the lever mounting groove 56*e* and the coupling lever 56*c* is connected to the lever mounting groove 56*e*.

In addition to the structure abovementioned, the filter handles 83*b* is provided on the top surface of the upper end supporter 83*b*. A pair of the filter handle 83*b* are provided at both sides on the top surface of the upper end supporter 83 respectively for the user to easily move or hold the filtering device 80

Contrary to the structure abovementioned, the filtering device 80 may be coupled to the top plate 56 by a male screw (not shown) provided at the upper end of the filtering device, i.e., on the outer circumferential surface of the upper end supporter, and by a female screw (not shown) provided on the inner circumferential surface of the upper end supporter.

A process for attaching or detaching the filtering device 80 structured as abovementioned to the top plate of the dust collecting container will be described.

First, when the filtering device 80 is inserted through the pass through hole 56*b* of the top lid and the projection 83*a* of the top end supporter 83 is stably mounted at the lever mounting groove 56*e* of the top plate 56, the filtering device 80 is provided tightly to the top plate 56 by rotating the coupling lever 56*c* to be overlapped to the top of the of the projection 83*a*.

Next, a process for detaching the filtering device 80 is carried out in reverse order, and the description of which will be omitted.

For exhausting the cleaned air cleaned by the cyclone principle and the filtering device to the outside of the dust collecting container, an inner flow tube 57 is provided in the dust collecting assembly, the inner flow tube having a first end communicating with the outlet 53 of the dust collecting assembly and a second end provided to a predetermined location on a center axis line of the dust collecting container 51 particularly provided to a bottom end of filtering device 80, and communicating with the clean air guiding passage 84 of the filtering device, and forming a passage for discharging the clean air from the dust collecting space.

In more detail, it is desirable that the outlet 53 of the dust collecting assembly is projected from a rear lower side of the top container, more desirably projected from the rear lower side of the top container to a rear side thereof with a predetermined height, and is inserted into and coupled with the clean air inlet 23 of the cleaner body 20, and the inner flow tube 57 includes a first flow tube 57*a* having a first end coupled with the outlet of the dust collecting assembly 53 and a second end horizontally extended to the center of the dust collecting container, and a second flow tube 57*b* having a first end coupled with the second end of the first flow tube 57*a* and a second end extended upward to the bottom end of the filtering device and communicating with the clean air guiding passage 84 of the filtering device, and a coupling part 57*c* of the first flow tube 57*a* and the second flow tube 57*b* is curved or inclined to minimize flow resistance of the cleaned air discharged from the dust collecting space.

It is desirable that a flow tube cover 57*d* is provided at an upper end of the inner flow tube 57, i.e., at the upper end of the second flow tube 57*b* for preventing the impurities form being flowed into the inner flow tube 57.

The flow tube cover 57*d* includes a round plate, which is formed in a radially incised form and made of an elastic material such as rubber, so as to prevent the impurities from being flowed into the inner flow tube 57 when the filtering device 80 is separated from the top plate 56 and withdrawn to the top of the top plate.

Owing to the structure abovementioned, the polluted air flowed into the dust collecting assembly 50 is cleaned firstly by separating large and heavy impurities according to the cyclone principle, and cleaned secondly by passing through the filtering device 80 for filtering the fine dust, and then exhausted through a clean air conduit of the cleaner body having the clean air guiding passage 84, the inner flow tube 57, and the fan.

It is obvious that the microscopic dust is additionally filtered before the air is discharged to outside of the vacuum cleaner by providing a third filter (not shown) at a predetermined location of the clean air conduit. The filters may include HEPA filters.

However, since the dust collecting assembly 50 with the abovementioned structure separates and collects impurities such as dust according to the cyclone principle, there is a problem that the impurities such as dust collected at a lower part of the dust collecting container 51 is risen by spiraled air in a process of spiral flow of the polluted air entered into the dust collecting assembly, and thereby lowering dust collecting efficiency.

Therefore, the dust collecting assembly 50 provided in the vacuum cleaner in accordance with the present invention further includes a separation plate 58 for separating the dust collecting space in the dust collecting container into an upper space and a lower space. In more detail, the separation plate 58 is provided in the vicinity of the filtering device 80 and the inner flow tube 57 such that the impurities separated from the upper space of the dust collecting container 51 is moved to the lower space of the dust collecting container, and the impurities collected at the lower space of the dust collecting container is prevented from being interfered by the air flow. In other words, at least one hole 58*a*, through which large dust particles pass, is provided on an edge of the separation plate 58.

In this case, the separation plate 58 is provided at a lower part of the filtering device 80 and rotated to be opened or closed. In more detail, the separation plate 58 is configured with two semicircular plates 58*b* and 58*c* rotated at upper part thereof, or formed in a round form or an elliptic form (not shown) having the center of gravity, which is one-sided about the rotation axis.

The separation plate 58 separating the inside of the dust collecting container 51 increases dust collecting efficiency by preventing the impurities such as dust piled up on the lower part of the dust collecting container 51 from being risen or rotated by flowing air, particularly spiraled air in the dust collecting assembly.

It is desirable that the dust collecting container 51 further includes an anti rotation plate 59 rotatably provided at the lower space thereof. In other words, the anti rotation plate 59 has a first end being coupled to an outer wall of the inner flow tube, a second end being coupled to an inner wall of the dust collecting container 51, and an upper end being close to the lower surface of the separation plate 58, so as to prevent the impurities collected in the lower space of the dust collecting container 51 from being scattered by the spiraled air.

Meanwhile, in the dust collecting assembly in accordance with the present invention, a sprayer 60 is provided in the dust collecting container 51 for spraying an insecticide or an antistatic.

The sprayer 60 includes a sprayer body 61 formed in a round form, a spray button 62 provided at an upper part of the sprayer body 61, and a spraying orifice 63 projected from the upper end of the sprayer body 61 to a side thereof.

The sprayer 60 uses a principle of a conventional sprayer and stores a spraying liquid is stored in the sprayer body 61. When a user presses an operating button 62*a* coupled to an upper part of the spray button and projected to the upper part of the top plate, the spray button 62 is pressed, and the spraying liquid in the sprayer body 61 is risen along a passage (not shown) and then sprayed through the spraying orifice.

The sprayer body 61 stores a material such as an antistatic, and the insecticide or germicide or fragrance may be added thereto.

In this case, the sprayer 60 is fixed on the upper inner wall of the dust collecting container 51 by a sprayer mounting member 64. The sprayer mounting member 64 includes a side supporter 64*a*, with a long length, perpendicularly provided for supporting the side of the sprayer body 61, a bottom supporter 64*b* projected from a lower end of the side supporter 64*a* to a side and supporting the lower surface of the sprayer body 61, and a couple of fixing member 64*c* projected from both sides in the middle of the side supporter 64*a* in a ring form for preventing the sprayer 60 from being escaped.

The bottom supporter 64*b* is shaped in a round plate form to be correspondent to a lower surface of the sprayer 60, and the fixing member 64*c* having elasticity is formed in a round form for covering the sprayer body 61 so as to fix the sprayer body 61. It is desirable that the bottom supporter 64*b* and the fixing member 64*c* are incorporated into the side supporter 64*a*.

The impurities collected in the lower space of the dust collecting container are discharged outside by opening the lower part of the dust collecting container, i.e., the bottom lid 51*b*. A first end of the bottom lid 51*b* is rotatably coupled with a first side of the lower end of the top container 51*a* by means of a hinge 51*c* and the lid fixing device 55 is provided at a second side of the lower end of the top container 51*a* such that a second end of the bottom lid 51*b* is selectively fixed.

In other words, when the lid fixing device 55 releases the bottom lid 51*b*, the bottom lid of the dust collecting container is opened by rotation, and the impurities collected in the lower space of the dust collecting container is discharged to the outside of thereof. When discharging the impurities is finished, the lid fixing device 55 fixes the bottom lid 51*b* so as to close the bottom of the dust collecting container 51.

In more detail, the lid fixing device 55 includes a hook member 55*a* having a hook at a lower part thereof for hooking the second end of the bottom lid 51*b*, and a hook supporter 55*c* having the hook member 55*a* rotatably coupled thereto by means of a rotation axis 55*b*. It is desirable that a projector 51*d* radially projected, or a hook receiving groove (not shown) is provided at the second end of the bottom lid 51*b*.

Meanwhile, an upper end of the hook member 55*a* is coupled to an outer wall of the dust collecting container 51*a* by a compression spring 55*d*, and the hook member 55*a* fixes the bottom lid 51*b* by restoring force of the compression spring 55*d*. In this case, the hook member 55*a* is formed in '<' form, bent to be symmetrical on the basis of the middle portion having the rotation axis 55*b* coupled thereto.

The bottom lid may be fixed by mounting the hook member 55*a* at the bottom lid 51*b* and by providing the projector on the outer wall of the top container 51*a*.

Figure 6:
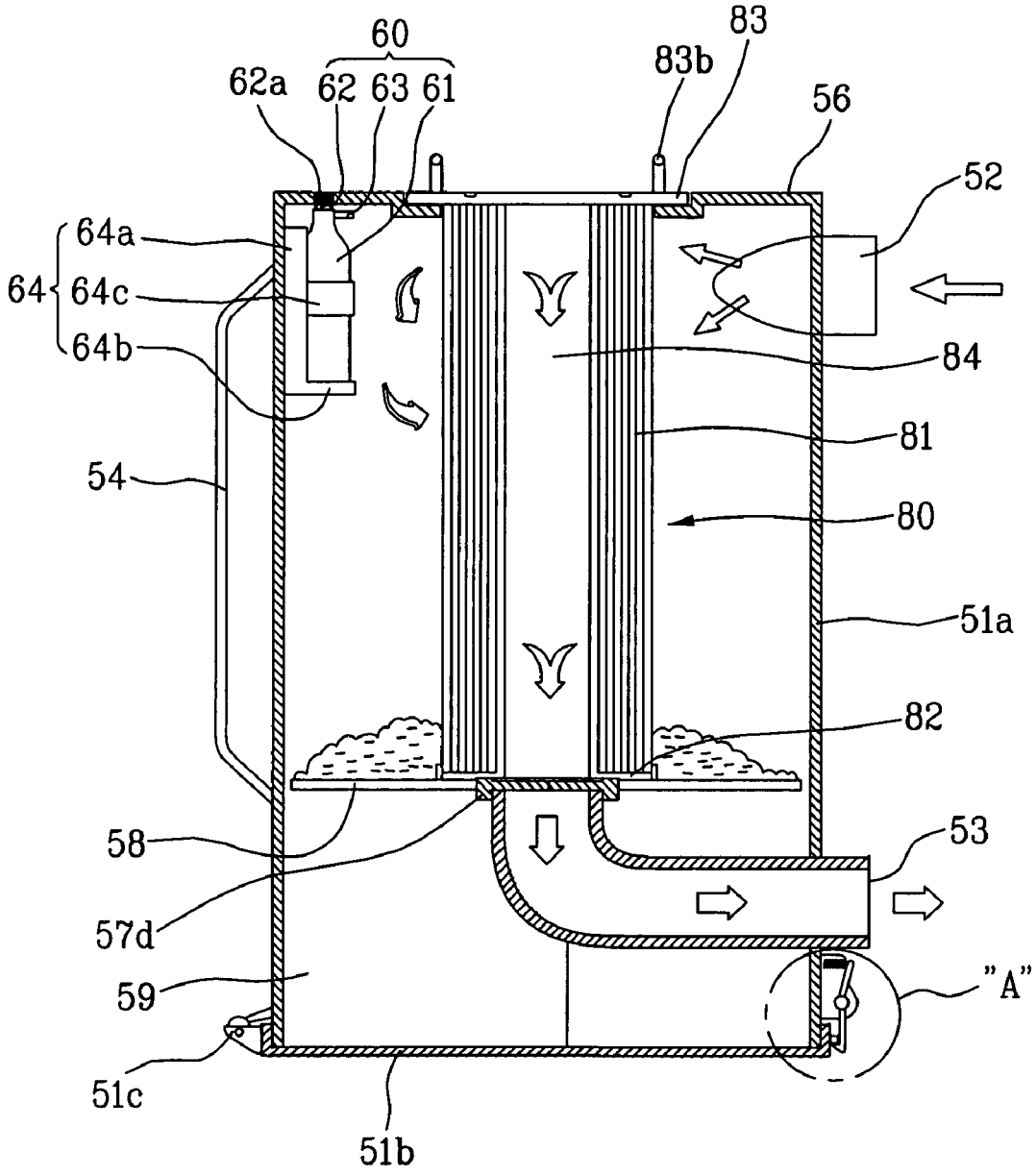
FIG. 6 illustrates a cross-sectional view showing the dust collecting assembly of FIG. 5.
Figure 7:
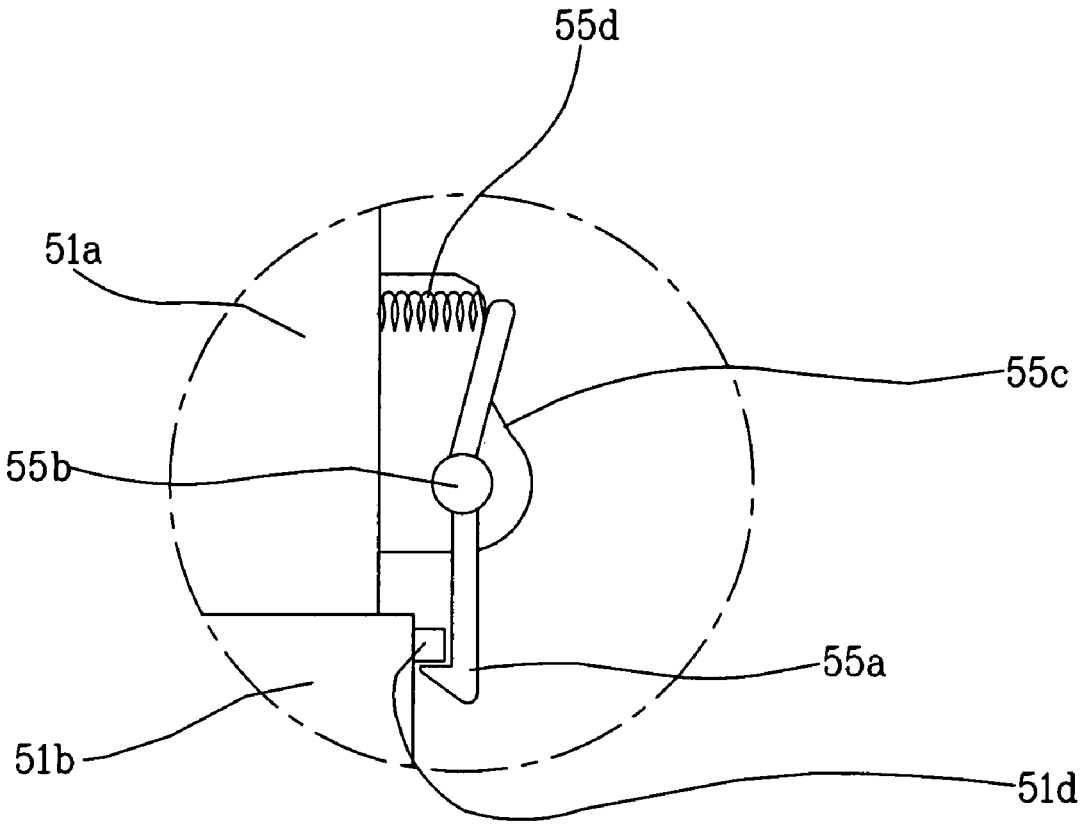
FIG. 7 illustrates a floor plan showing an amplified "A" section of FIG. 5.
Figure 8:
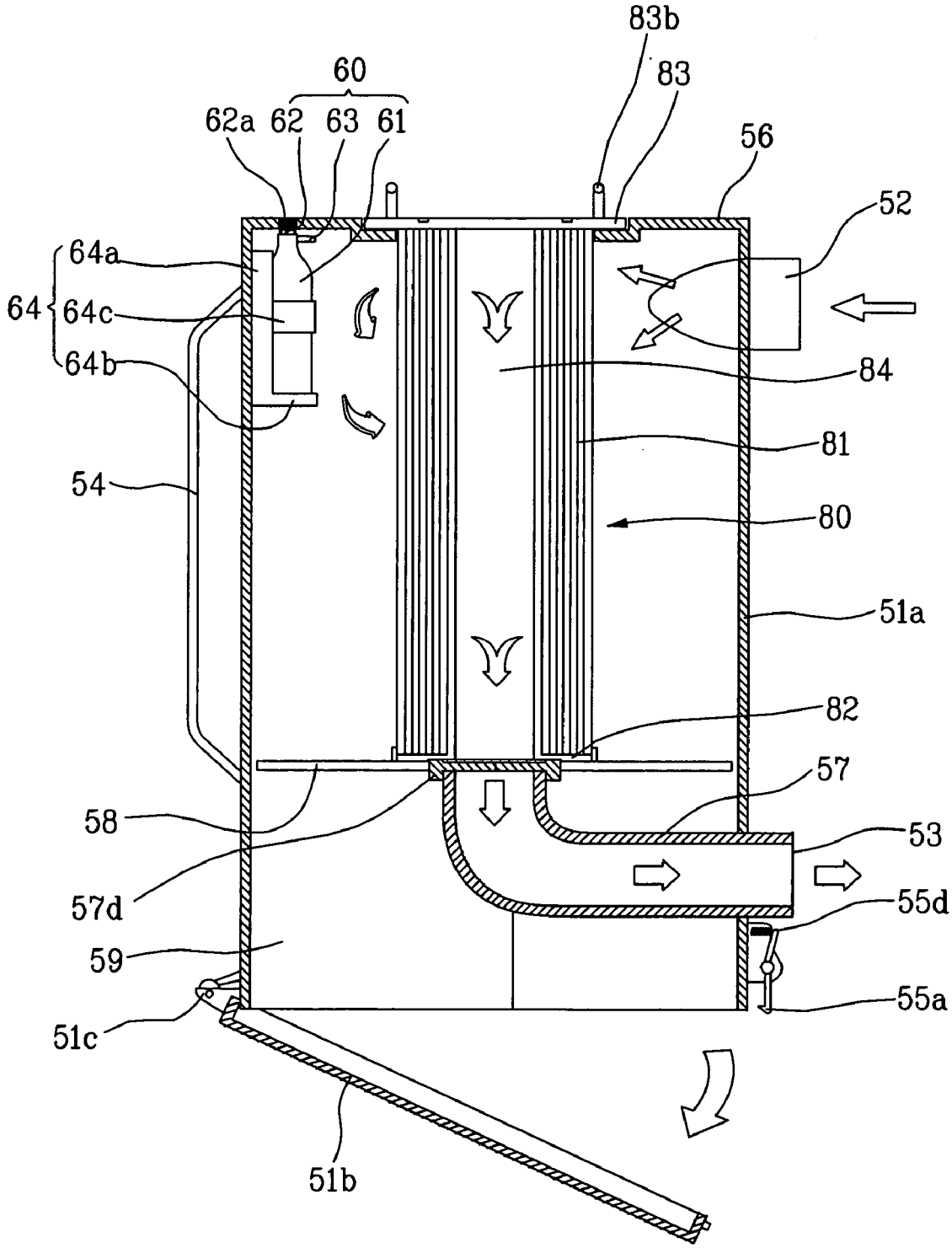
FIG. 8 illustrates a cross-sectional view showing an opened lower lid of the dust collecting assembly of FIG. 5.

A process for opening or closing the bottom lid 51*b* by using the lid fixing device 55 structured as abovementioned will be described as follows referring to FIG. 6 to FIG. 8.

First, for discharging the impurities in the dust collecting assembly, the user needs to press the top end of the hook member 55*a* to the outer wall of the dust collecting container such that the hook member 55*a* releases the bottom lid when the bottom lid is fixed by the lid fixing device 55 and the bottom of the dust collecting container 51 is shut tightly.

Accordingly, the bottom lid 51*b* opens the bottom of the dust collecting container 51 while rotating downward about the hinge 51*c*, and the impurities in the dust collecting assembly are discharged outside by gravity.

Next, for tightly shutting the bottom of the dust collecting container 51, the user needs to rotate the bottom lid 51*b* such that the projector 51 d of the bottom lid 51*b* is caught by the hook member 55*a*.

Next, the referring to FIG. 9 to FIG. 11, a second embodiment of the dust collecting assembly provided at the vacuum cleaner in accordance with the present invention will be described. In describing the second embodiment of the dust collecting assembly, the same reference numbers will be used to refer to the same or like parts of the first embodiment, and detailed description for the same parts will be omitted.

Figure 9:
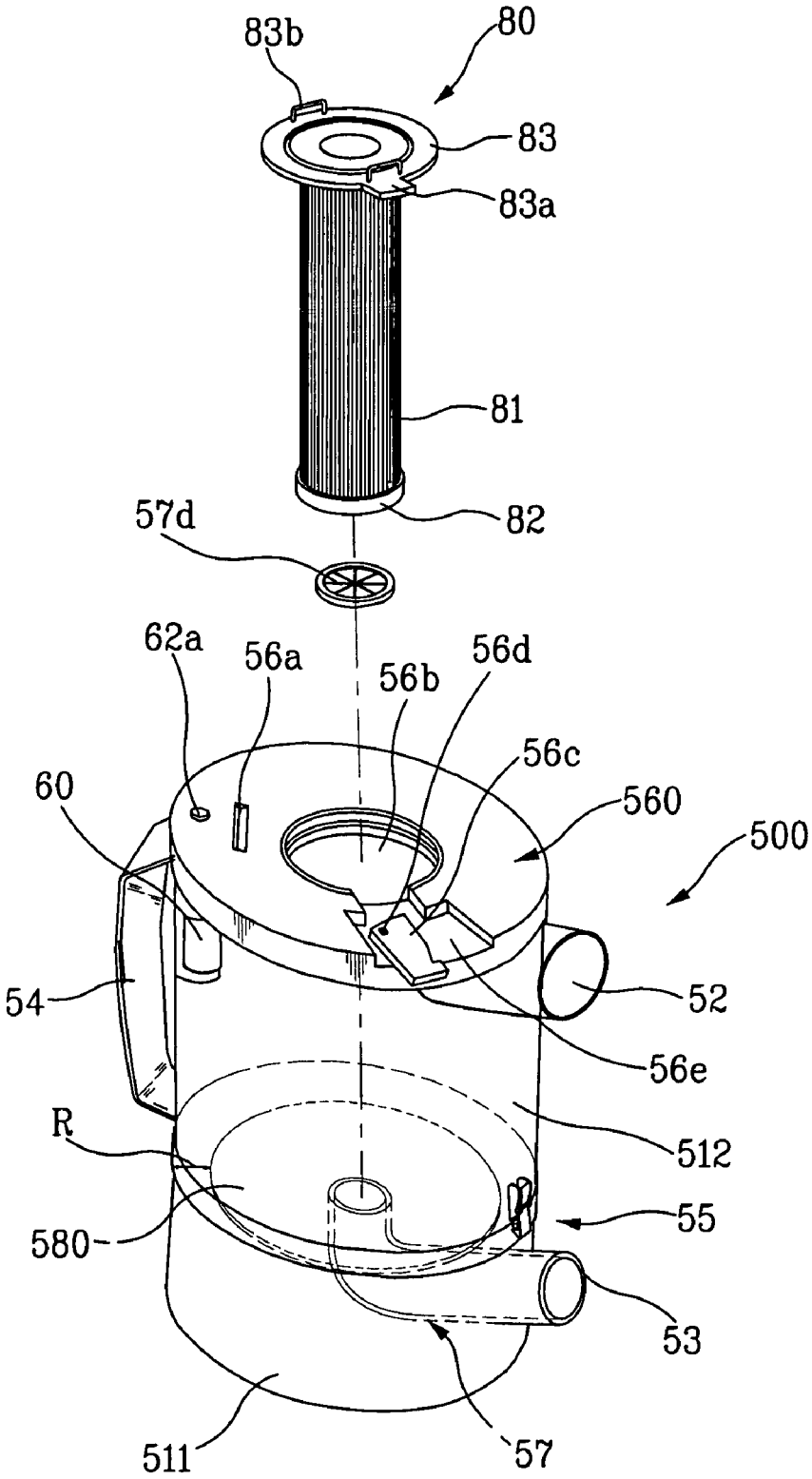
FIG. 9 illustrates a perspective view showing a second embodiment of a dust collecting assembly provided in a vacuum cleaner in accordance with the present invention.
Figure 10:
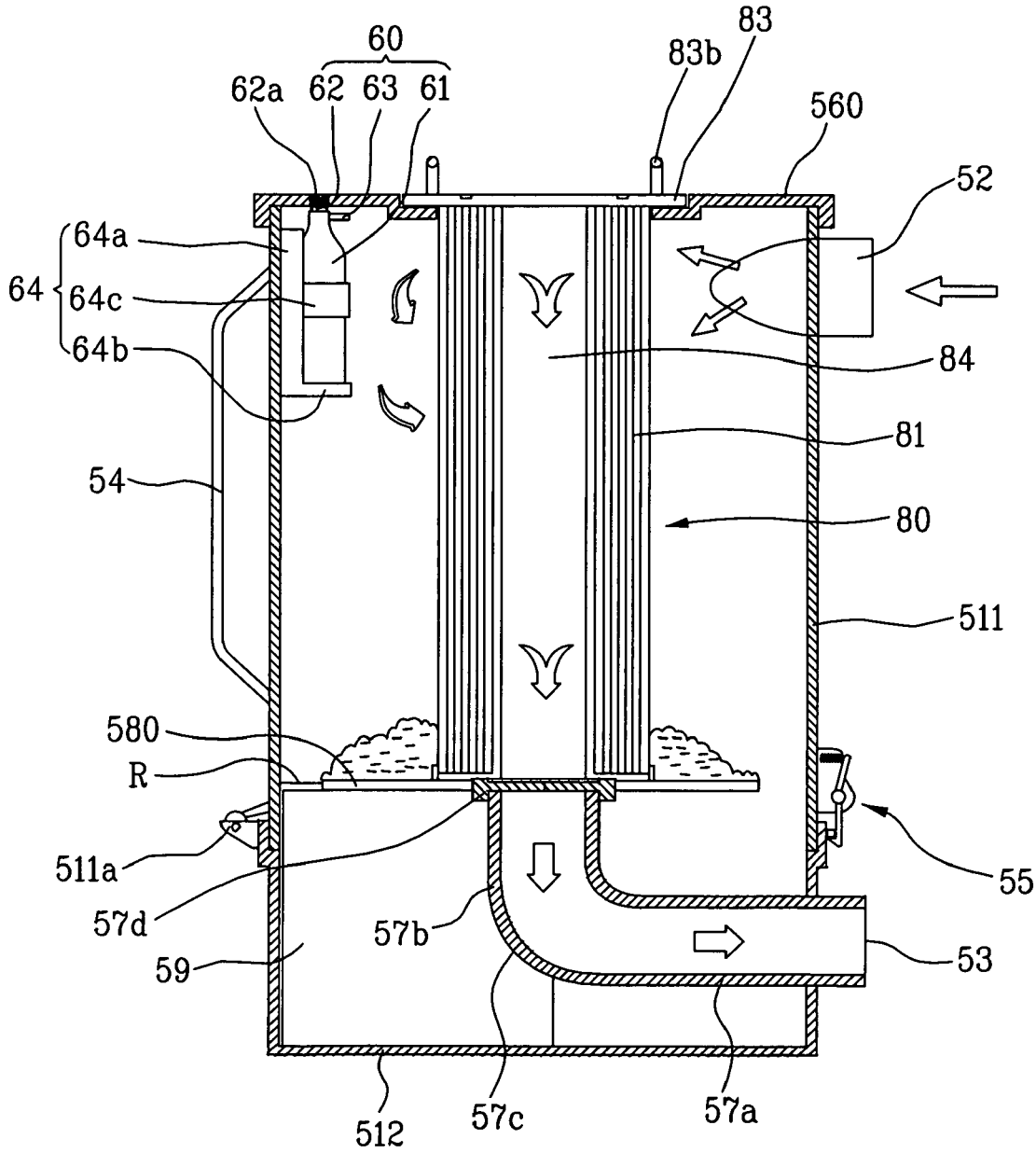
FIG. 10 illustrates a cross-sectional view showing the dust collecting assembly of FIG. 9.
Figure 11:
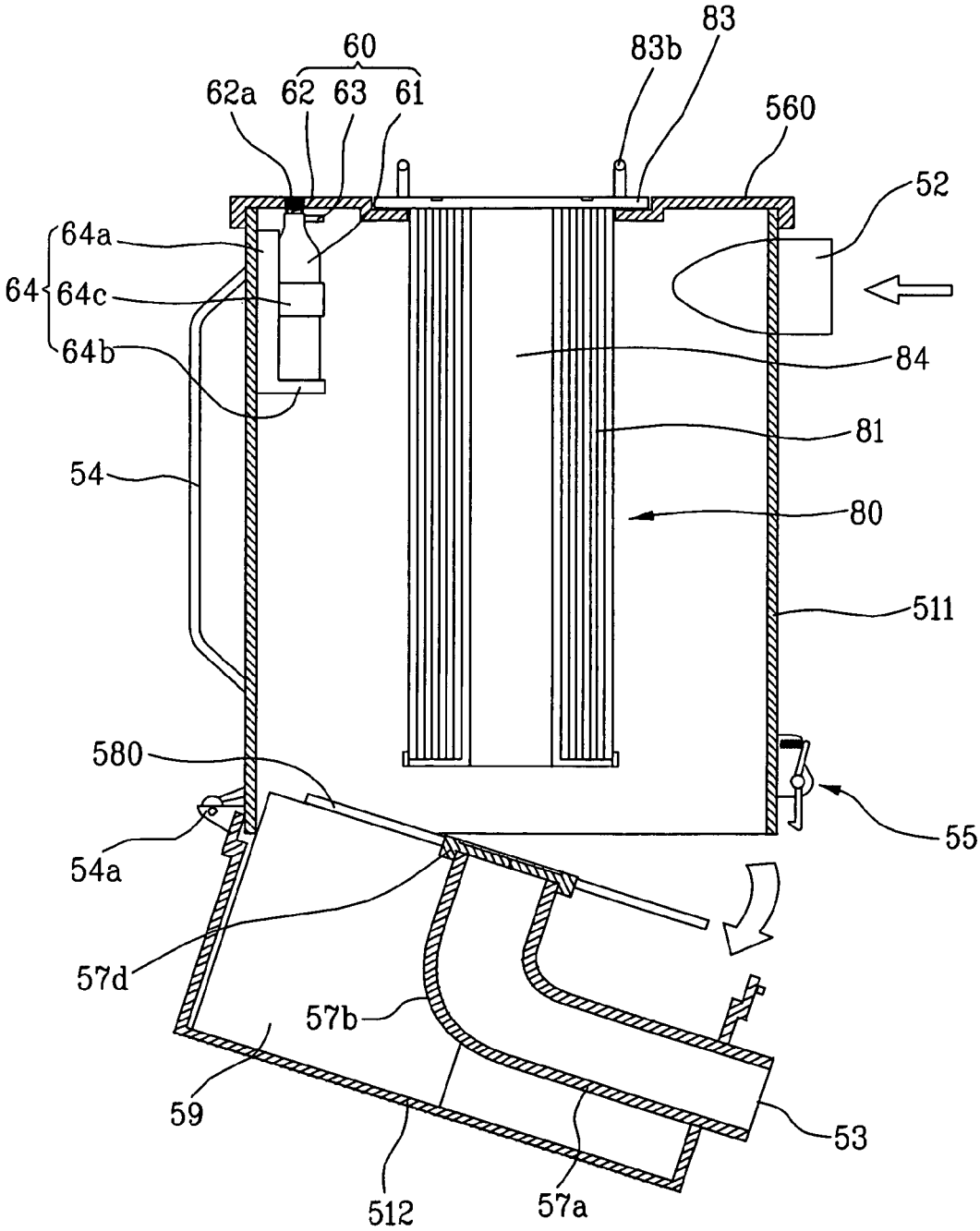
FIG. 11 illustrates a cross-sectional view showing an opened lower lid of the dust collecting assembly of FIG. 9.

Referring to FIG. 9 to FIG. 11, the dust collecting assembly 500 in accordance with the second embodiment includes a dust collecting container formed in a cylindrical form, having opened top and bottom and having a dust collecting space therein for collecting the impurities, an inlet 52 provided on a rear upper side of the dust collecting container for sucking polluted air, an outlet 53 provided on a rear lower side of the dust collecting container, a dust collecting container handle 54 provided on a front outer wall of the dust collecting container, a filtering device 80 detachably coupled on the upper surface of the dust collecting container, an inner flow tube 57 for guiding clean air separated from the impurities in the filtering device to the outside of the dust collecting container, and a separation plate 580 for separating the dust collecting space of the dust collecting container into an upper part and a lower part.

In the second embodiment of the dust collecting assembly with the abovementioned structure, the dust collecting container includes a top container 511 having opened top and bottom and formed in a cylindrical form, a top plate 560 for opening and closing the top of the top container 511, and a bottom lid 512 for opening and closing the bottom of the top container 511.

Contrary to the top plate of the dust collecting container in accordance with the first embodiment, the top plate 560 is detachably provided at an upper end of the top container 511. However, other parts of the top plate 560 are the same as the dust collecting assembly 50 in accordance with the first embodiment and description of which will be omitted.

Next, the bottom lid 512 has a first end rotatably coupled to a first lower end of the top container 511 by a hinge 511*a*, and the lid fixing device 55 is provided at a second lower end thereof so as to selectively fix the second end of the bottom lid 511.

In the second embodiment, the bottom lid 512 is incorporated integrally into the inner flow tube 57, and the inner flow tube 57 is incorporated integrally into the separation plate 580 such that the inner flow tube 57 and the separation plate 580 are rotated at the same time when the bottom lid 512 is rotated by a rotation. For that reason, a first flow tube of the inner flow tube passes through a side rim of the bottom lid 512, and the separation plate 580 is fixed at the upper end of a second flow tube 57*b* of the inner flow tube.

In this case, an outside diameter of the separation plate 580 is smaller than an inside diameter thereof and a predetermined gap (R) is formed between the separation plate 580 and the dust collecting container such that the impurities such as dust passed through the gap (R) are collected inside the bottom lid 512.

Among the vacuum cleaners structured as mentioned above in accordance with the present invention, movement of the vacuum cleaner including the dust collecting assembly in accordance with the second embodiment in FIGS. 9 to 11 is described as follows.

First, when power is supplied and the vacuum cleaner begins to function, the brush 12*b* provided at the suction nozzle 10 is rotated by operation of the motor in the cleaner body 20 so as to separate dust being stuck on the floor, and the fan coupled to the motor is rotated so as to suck the polluted air containing impurities such as dust through the main inlet of the suction nozzle 10.

The polluted air sucked through the main inlet is flowed into the dust collecting assembly through the polluted air outlet 24 of the cleaner body 20 communicating with the inlet 52 of the dust collecting assembly.

Air flowed into the dust collecting assembly 500 flows cyclonically such that the large impurities are separated from the polluted air, passed through the gap (R) between the separation plate and the dust collecting container, and then collected at a lower part of the dust collecting container, i.e., inside the bottom lid 512.

In this instance, the separation plate 580 divides the dust collecting container into a top space and a bottom space so as to prevent the impurities collected at the lower part of the dust collecting container 510 from being rotated by the spiraled air formed in the dust collecting container, or being risen to the upper space of the dust collecting container, i.e., the top container 511.

The air from which the large impurities are separated by the cyclone principle passes through the filtering device 80 for separating the minute dust so as to be cleaned.

In a process of collecting the impurities, the sprayer 60 prevents static electricity, destroys insects, or gives out a fragrance by spraying an antistatic, insecticide, or fragrance into the dust collecting assembly.

The minute dust separated by the filtering device 80 is collected in the dust collecting container, and the air cleaned by the filtering device 80 is guided by the inner flow tube 57 so as to be discharged through the outlet of the dust collecting assembly 53 and flowed into the clean air conduit having the clean air inlet 23.

The air flowed into the clean air conduit is passed through the fan and discharged to the outside of the vacuum cleaner through the clean air exhausting port 25.

When a predetermined amount of impurities are piled in the dust collecting container through the abovementioned process, a user discharges the impurities piled up in the bottom lid 512 by pressing the hook 55*a* of the lid fixing device 55 for opening the bottom lid 512 by a rotation of the bottom lid 512.

Although the upright type vacuum cleaner having a cleaner body coupled with the upper part of the head is mainly discussed in the preferred embodiment of the present invention, the structure is not limited to the present invention, but can be applied to a canister type vacuum cleaner having the head and the cleaner body separately provided.

Figure 12:
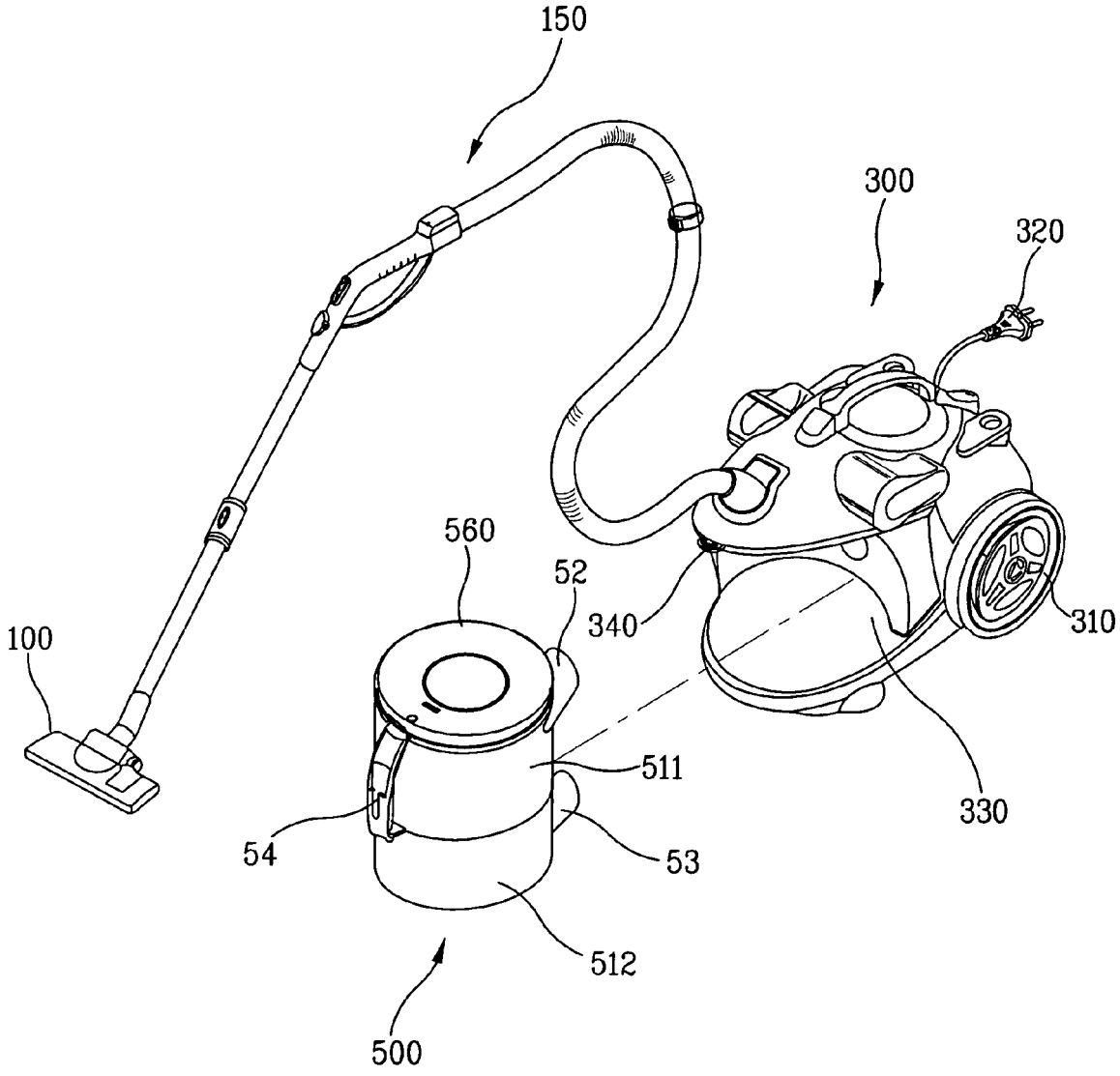
FIG. 12 illustrates a perspective view showing another embodiment of a vacuum cleaner in accordance with the present invention.

FIG. 12 illustrates a separate perspective view showing an example that the second embodiment of the dust collecting assembly is applied to the canister type vacuum cleaner.

The canister type vacuum cleaner includes a suction nozzle 100 for sucking the impurities from outside, a cleaner body 300 having a dust collecting assembly receiving recess 330, to which the dust collecting assembly is mounted, and a coupling pipe 150 for coupling the suction nozzle 100 with the cleaner body 300 and guiding the polluted air to the cleaner body.

The cleaner body 300 includes a wheel 310, an electric wire 320, and a detaching device 340 for attaching and detaching the dust collecting assembly.

The dust collecting assembly 500 mounted at the dust collecting assembly receiving recess 330 of the cleaner body 300 structured as abovementioned separates and collects the impurities contained in the polluted air sucked through the suction nozzle 100.

The effect of the vacuum cleaner is summarized as follows. First, according to the vacuum cleaner in accordance with the present invention, the clean air inlet is provided on the rear inner wall of the dust collecting assembly receiving recess to face the front thereof. Therefore, even though carelessness of an unprofessional manipulation of the user caused a gap between the clean air inlet and the outlet of the dust collecting assembly during assembly of the dust collecting assembly, the airtighteness between the dust collecting assembly and the main body is maintained because air is sucked from the clean air inlet by the operation of the air sucking device and thus the dust collecting assembly is closely adhered to the rear side of the dust collecting assembly receiving recess by air suction force.

Second, according to the vacuum cleaner in accordance with the present invention, since the outlet of the dust collecting assembly coupled to the clean air inlet is projected to the outside of the dust collecting container or depressed to the inner side thereof, it is easy to couple the outlet with the clean air inlet, thereby making it easy to mount the dust collecting assembly.

Third, according to the vacuum cleaner in accordance with the present invention, since attaching and detaching of the filtering device provided in the dust collecting assembly is easy, exchanging and cleaning the filtering device are easy.

Fourth, according to the vacuum cleaner in accordance with the present invention, electrostatic phenomenon is prevented by operation of a sprayer provided in the dust collecting assembly so as to prevent the user from being shocked by static electricity. When an insecticide or a fragrance is stored in the sprayer, the inside of the sprayer is sterilized or an odor is removed.

Five, according to the vacuum cleaner in accordance with the present invention, since a bottom lid is provided for opening and closing a bottom of the dust collecting container, it is easy to discharge the impurities.

Sixth, according to the vacuum cleaner in accordance with the present invention, a top lid and the bottom lid are provided for opening and closing the top and bottom of the dust collecting container, thereby making easy to discharge the impurities and to clean the dust collecting assembly.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A vacuum cleaner, comprising:

a suction nozzle that sucks air containing impurities;

a dust collecting assembly, comprising:

a dust collecting container having a dust collecting space and having an openable and closable bottom;

an inlet through which air is drawn into the dust collecting container;

a filtering device detachably mounted in the dust collecting container that filters impurities;

a top plate having a pass through hole, wherein the filtering device is configured to be inserted into and withdrawn from an upper side of the dust collecting assembly through the pass through hole, and wherein the filtering device is coupled to the top plate; and an outlet through which clean air is exhausted;

a cleaner body, comprising:

a dust collecting assembly receiving recess that detachably receives the dust collecting assembly;

a polluted air outlet that communicates with the inlet of the dust collecting assembly, and that delivers air sucked through the suction nozzle to the dust collecting assembly;

a clean air inlet provided on an inner wall of the dust collecting assembly receiving recess so as to face the direction of mounting of the dust collecting assembly, and communicating with the outlet of the dust collecting assembly; and a clean air conduit including a fan rotated by a motor, wherein a first end of the clean air conduit communicates with the clean air inlet and a second end of the clean air conduit has a clean air outlet that exhausts the clean air to the outside of the vacuum cleaner.

2. The vacuum cleaner of claim 1, wherein the dust collecting container comprises:

a top container formed in a cylindrical form, wherein a bottom lid of the top container has a first end that is rotatably connected to a first side of a lower end of the top container for opening and closing a bottom of the top container; and a lid fixing device that selectively couples the bottom lid to a second side of the lower end of the top container such that the bottom lid opens or closes the bottom of the top container.

3. The vacuum cleaner of claim 2, wherein the lid fixing device comprises:

a hook member having a hook that catches a second end of the bottom lid; and a hook supporter provided at a side of the top container that supports the hook member.

4. The vacuum cleaner of claim 3, wherein the hook member is rotatably coupled to the hook supporter and wherein a second end of the hook is coupled to an elastic member providing a restoring force.

5. The vacuum cleaner of claim 3, wherein the bottom lid comprises a projection that is caught by the hook of the hook member.

6. The vacuum cleaner of claim 2, wherein the dust collecting assembly further comprises an inner flow tube having a first end communicating with the outlet of the dust collecting assembly and a second end communicating with the filtering device, and guiding the clean air from the filtering device to the outside of the dust collecting container.

7. The vacuum cleaner of claim 6, wherein the inner flow tube of the dust collecting assembly comprises:

a first flow tube having a first end communicating with the outlet of the dust collecting assembly and a second end extended toward a center of the dust collecting container; and a second flow tube having a first end connected to the second end of the first flow tube, and a second end extended upward to a lower end of the filtering device.

8. The vacuum cleaner of claim 7, wherein the inner flow tube comprises a connecting part that couples the first flow tube and the second flow tube, and wherein the connecting part is curved or inclined so as to minimize flow resistance of the clean air discharged from the dust collecting space.

9. The vacuum cleaner of claim 6, wherein the inner flow tube is incorporated integrally into the bottom lid and passes through a rim of the bottom lid.

10. The vacuum cleaner of claim 6, wherein the inner flow tube comprises a flow tube cover provided at the second end thereof to prevent impurities from flowing into the inner flow tube.

11. The vacuum cleaner of claim 1, wherein the filtering device is coupled to the top plate by means of a projection formed at an upper end of the filtering device and a coupling lever provided on an upper surface of the top plate that couples to the projection.

12. The vacuum cleaner of claim 1, wherein the top plate is openably and closably provided at an upper part of the dust collecting container.

13. The vacuum cleaner of claim 1, wherein the filtering device comprises:

a filter formed in a cylindrical form that filters the impurities; and a filter supporter having an upper end coupled to the top plate that supports the filter.

14. The vacuum cleaner of claim 1, wherein the dust collecting assembly is attached or detached from a front of the cleaner body.

15. The vacuum cleaner of claim 14, wherein the outlet of the dust collecting assembly discharges the clean air to a rear side of the dust collecting container, and the clean air inlet is provided on a rear inner wall of the dust collecting assembly receiving recess.

16. The vacuum cleaner of claim 1, wherein the dust collecting assembly further comprises a separation plate that divides an inner space of the dust collecting container into an upper space and a lower space.

17. The vacuum cleaner of claim 16, wherein the separation plate is rotatably provided in the dust collecting container.

18. The vacuum cleaner of claim 17, wherein the separation plate comprises two semicircular plates provided in the dust collecting container so that the semicircular plates rotate in an upper direction of the dust collecting container.

19. The vacuum cleaner of claim 1, wherein the inlet of the dust collecting assembly is provided in a tangential direction at a predetermined location on a side of the dust collecting container such that the polluted air drawn into the inner space of the dust collecting container spirally flows.

20. A vacuum cleaner, comprising:

a suction nozzle that sucks an air containing impurities;

a dust collecting assembly, comprising:

a dust collecting container having a dust collecting space;

an inlet through which air is drawn into the dust collecting container;

a filtering device mounted in the dust collecting container that filters impurities, an outlet through which clean air is exhausted; and an inner flow tube having a first end that is coupled to the filtering device and a second end that is coupled to the outlet, wherein the inner flow tube includes a first portion that extends vertically downward from the filtering device and a second portion that extends horizontally from an end of the first portion to the outlet; and a cleaner body comprising:

a dust collecting assembly receiving recess that detachably receives the dust collecting assembly;

a polluted air outlet that communicates with the inlet of the dust collecting assembly;

a clean air inlet that communicates with the outlet of the dust collecting assembly; and a clean air conduit having a first end that communicates with the clean air inlet and a second end that exhausts the clean air to the outside of the vacuum cleaner, wherein the dust collecting container further comprises a top plate having a pass through hole, wherein the filtering device is configured to be inserted into and withdrawn from an upper side of the dust collecting assembly through the pass through hole, and wherein the filtering device is coupled to the top plate.

21. The vacuum cleaner of claim 20, further comprising a flow tube cover mounted on the inner flow tube, wherein the flow tube cover acts to prevent impurities from flowing from the filtering device into the inner flow tube.

22. The vacuum cleaner of claim 20, wherein the inner flow tube further comprises a connecting portion that connects the first portion of the inner flow tube to the second portion of the inner flow tube, and wherein the connecting portion is curved.

23. A vacuum cleaner, comprising:

a suction nozzle that sucks an air containing impurities;

a dust collecting assembly, comprising:

a dust collecting container having a dust collecting space;

an inlet through which air is drawn into the dust collecting container;

a filtering device mounted in the dust collecting container that filters impurities, an outlet through which clean air is exhausted;

an inner flow tube having a first end that is coupled to the filtering device and a second end that is coupled to the outlet, and wherein a flow tube cover is mounted on the inner flow tube to prevent impurities from flowing from the filtering device into the inner flow tube; and a cleaner body comprising:

a dust collecting assembly receiving recess that detachably receives the dust collecting assembly;

a polluted air outlet that communicates with the inlet of the dust collecting assembly;

a clean air inlet that communicates with the outlet of the dust collecting assembly; and a clean air conduit having a first end that communicates with the clean air inlet and a second end that exhausts the clean air to the outside of the vacuum cleaner.

24. A vacuum cleaner, comprising:

a suction nozzle that sucks an air containing impurities;

a dust collecting assembly, comprising:

a dust collecting container having a dust collecting space;

an inlet through which air is drawn into the dust collecting container;

a filtering device mounted in the dust collecting container that filters impurities, an outlet through which clean air is exhausted;

a bottom lid having a first side that is rotationally coupled to a lower portion of the dust collecting container so as to open and close a lower portion of the dust collecting container;

a hook member that is rotationally mounted on the lower portion of the dust collecting container to allow a first end of the hook member to releasably latch to a projection on a second side of the bottom lid; and an elastic member mounted between the dust collecting container and a second end of the hook member that biases the hook member towards a latched position; and a cleaner body comprising:

a dust collecting assembly receiving recess that detachably receives the dust collecting assembly;

a polluted air outlet that communicates with the inlet of the dust collecting assembly;

a clean air inlet that communicates with the outlet of the dust collecting assembly; and a clean air conduit having a first end that communicates with the clean air inlet and a second end that exhausts the clean air to the outside of the vacuum cleaner, wherein the dust collecting container further comprises a top plate having a pass through hole, wherein the filtering device is configured to be inserted into and withdrawn from an upper side of the dust collecting assembly through the pass through hole, and wherein the filtering device is coupled to the top plate.

* * * * *